US008931853B1

(12) United States Patent
Taylor, Jr.

(10) Patent No.: US 8,931,853 B1
(45) Date of Patent: Jan. 13, 2015

(54) APPARATUS FOR CUTTING CONCRETE CURBS OR OTHER FIXED STRUCTURES

(71) Applicant: Edgar Josiah Taylor, Jr., Anderson, CA (US)

(72) Inventor: Edgar Josiah Taylor, Jr., Anderson, CA (US)

( * ) Notice: Subject to any disclaimer, the term of this patent is extended or adjusted under 35 U.S.C. 154(b) by 0 days.

(21) Appl. No.: 13/792,518

(22) Filed: Mar. 11, 2013

(51) Int. Cl.
*E01C 23/09* (2006.01)
*B28D 1/04* (2006.01)

(52) U.S. Cl.
CPC ..... *E01C 23/094* (2013.01); *B28D 1/045* (2013.01); *Y10S 83/928* (2013.01)
USPC ..... 299/39.3; 299/72; 83/928

(58) Field of Classification Search
CPC ..... E01C 23/0933; Y10S 83/928
USPC ..... 299/39.3, 41.1, 72, 75; 125/13.03; 83/499; 30/379.5
See application file for complete search history.

(56) References Cited

U.S. PATENT DOCUMENTS

| | | | | | |
|---|---|---|---|---|---|
| 1,832,599 | A * | 11/1931 | Wilhelm et al. | 83/490 |
| 3,649,071 | A * | 3/1972 | Graff | 299/41.1 |
| 3,785,705 | A * | 1/1974 | Binger et al. | 299/75 |
| 4,271,879 | A * | 6/1981 | Shivers et al. | 144/24.12 |
| 4,433,871 | A * | 2/1984 | Bertrand | 299/41.1 |
| 4,792,190 | A * | 12/1988 | Bertrand | 299/41.1 |
| 4,832,412 | A * | 5/1989 | Bertrand | 299/39.3 |
| 5,135,287 | A * | 8/1992 | Karnes | 299/39.3 |
| 5,230,270 | A * | 7/1993 | Bertrand | 83/489 |
| 5,362,176 | A * | 11/1994 | Sovik | 404/72 |
| 5,676,125 | A * | 10/1997 | Kelly et al. | 125/13.03 |
| 5,893,677 | A * | 4/1999 | Haehn et al. | 404/90 |
| 6,158,817 | A * | 12/2000 | Bertrand | 299/39.3 |
| 6,203,112 | B1 * | 3/2001 | Cook et al. | 299/39.3 |
| 6,582,026 | B2 * | 6/2003 | Bertrand | 299/39.3 |
| 7,387,464 | B2 * | 6/2008 | Hall et al. | 404/94 |
| 2011/0203565 | A1 * | 8/2011 | Hilsgen et al. | 125/13.03 |

* cited by examiner

*Primary Examiner* — David Bagnell
*Assistant Examiner* — Michael Goodwin
(74) *Attorney, Agent, or Firm* — Thomas R. Lampe

(57) ABSTRACT

Apparatus for cutting concrete curbs or other fixed structures includes an articulated saw support operable to move a saw to position the saw blade in horizontal or vertical planes or canted relative to one or both of the horizontal and vertical planes.

7 Claims, 6 Drawing Sheets

APPARATUS FOR CUTTING CONCRETE CURBS OR OTHER FIXED STRUCTURES

TECHNICAL FIELD

This invention relates to apparatus for cutting concrete curbs, but which also may be utilized to cut other fixed structures.

BACKGROUND OF THE INVENTION

It is known to utilize machines that are mobile to cut concrete curbs and the like. However, such arrangements are relatively expensive and limited in application. More particularly, although such devices employ a rotary saw blade (as does the apparatus of the present invention), orientation and placement of the blade during use are highly restricted, thus limiting the types of cuts that can be made.

DISCLOSURE OF INVENTION

The present invention relates to apparatus which enables the rotary saw blade employed to be rapidly adjusted and modified to provide different blade orientations to perform different types of cuts in a concrete curb or other fixed structure.

The apparatus includes a vehicle for moving relative to a concrete curb or other fixed structure, the vehicle including a vehicle framework.

The primary saw support structure is mounted for movement relative to the vehicle framework.

First prime mover structure is employed for moving the primary saw support structure relative to the vehicle framework.

An articulated saw support is provided that includes second prime mover structure connected to the primary saw support structure.

A saw having a rotary saw blade is attached to the articulated saw support, actuation of the first prime mover structure operable to move the primary saw support structure and the saw toward or away from the curb or other fixed structure.

The second prime mover structure is operable to move the saw to selectively alternatively position the saw blade in horizontal or vertical planes or canted relative to one or both of the horizontal and vertical planes.

Other features, advantages and objects of the present invention will become apparent with reference to the following description and accompanying drawings.

BEST MODE FOR CARRYING OUT THE INVENTION

Figure 1:
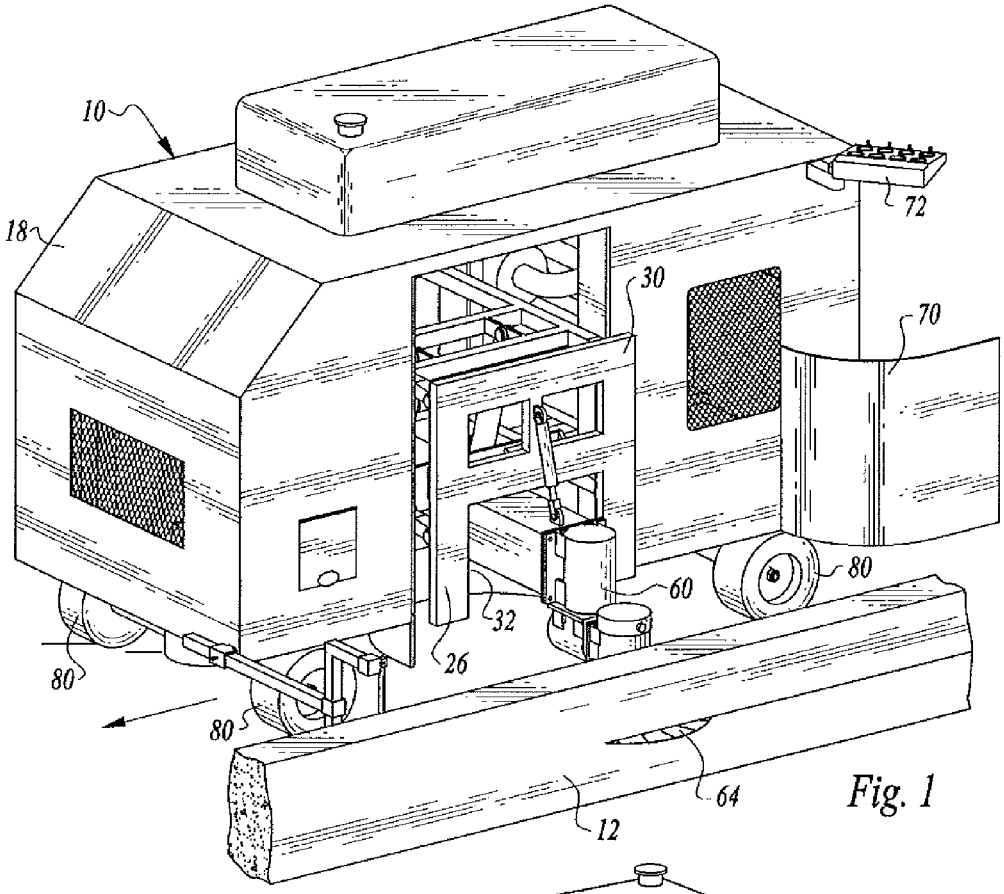
FIG. 1 is a is a perspective view illustrating a front and side of apparatus constructed in accordance with the teachings of the present invention moving next to a curb with the saw blade of the apparatus disposed in a horizontal orientation, extending through the curb and cutting the curb.
Figure 4:
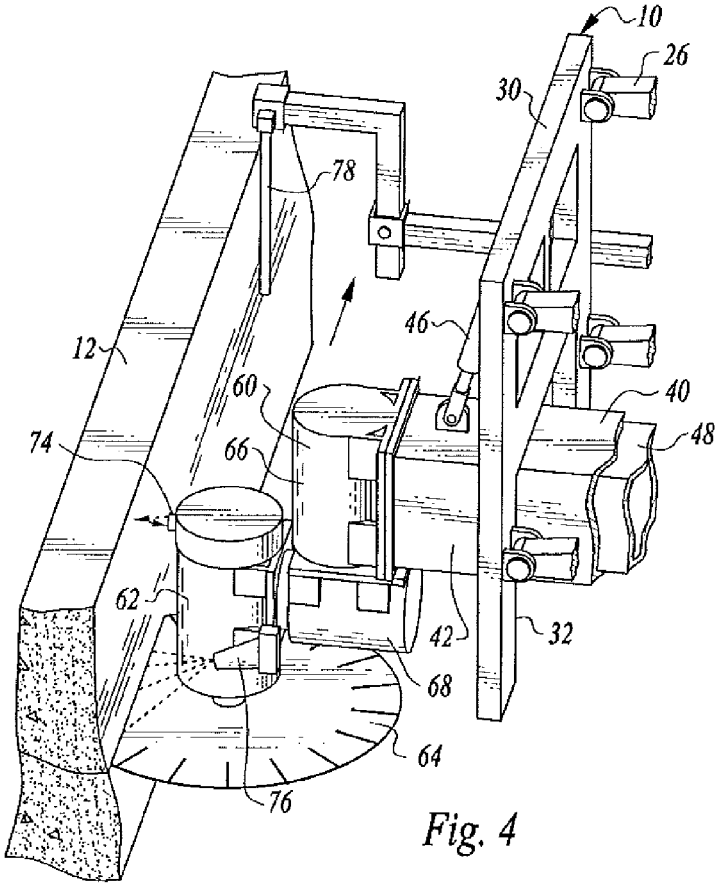
FIG. 4 is an enlarged, sectional view illustrating selected structural components of the apparatus, including primary and articulated saw supports thereof in conjunction with a saw having a rotary saw blade performing a horizontal cut in a curb.
Figure 15:
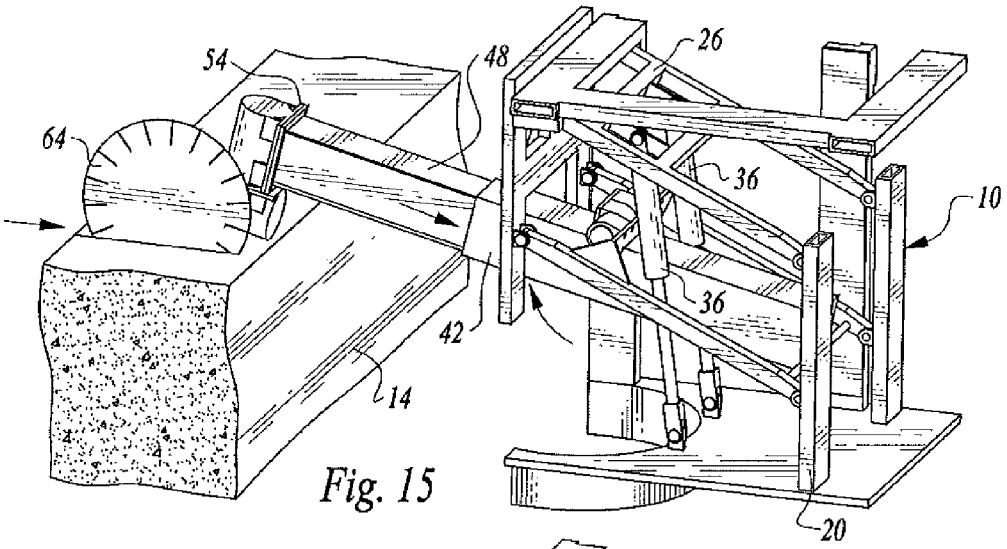
FIG. 15 is a perspective view of the saw blade making a cut in the top of an elongated concrete block, the telescopic structure of the primary saw support structure being inclined upwardly and telescoping to complete the cut in the top of the block.
Figure 16:
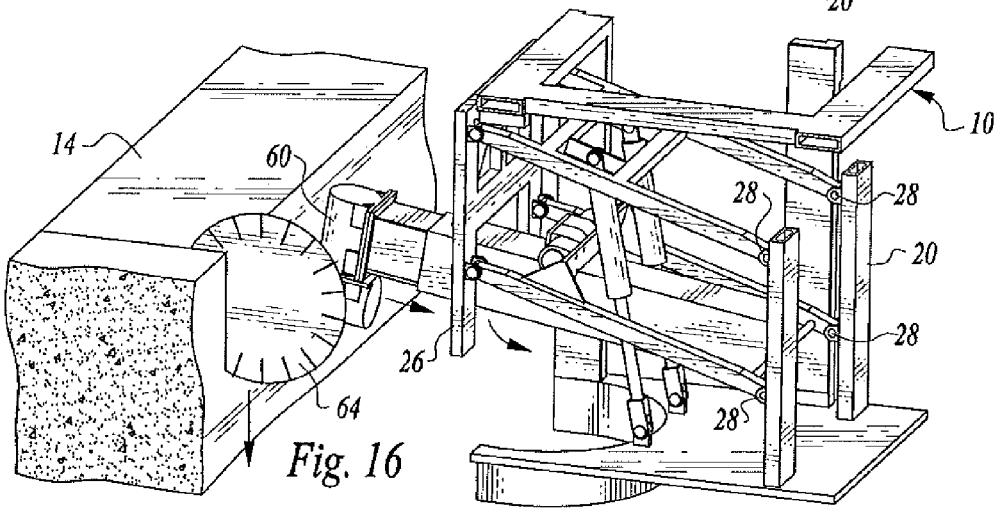
FIG. 16 is a view similar to FIG. 15, but depicting the telescopic structure of the primary saw support structure telescoping and moving downwardly to form a cut at a vertical face of the block.
Figure 17:
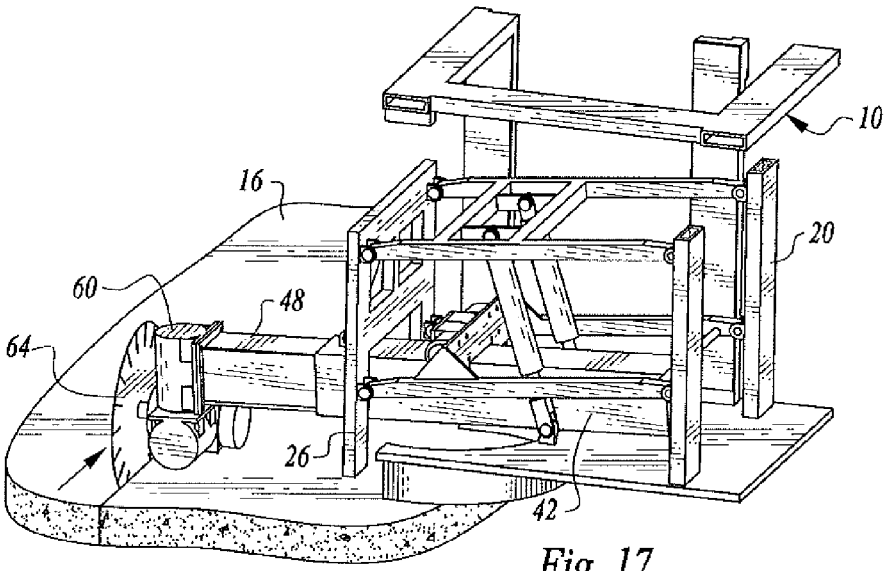
FIG. 17 is a view similar to FIGS. 15 and 16, but illustrating the condition of the apparatus components when a vertical cut is being made by the saw in a concrete slab or roadway.

Referring now to the drawings, apparatus constructed in accordance with the teachings of the present invention is identified by reference numeral 10. The apparatus is employed for cutting concrete curbs or other fixed structures. FIGS. 1 and 4 show a relatively narrow curb 12 being cut. FIGS. 15 and 16 show a block 14 being cut. And FIG. 17 shows a concrete slab or roadway 16 being cut.

Figure 2:
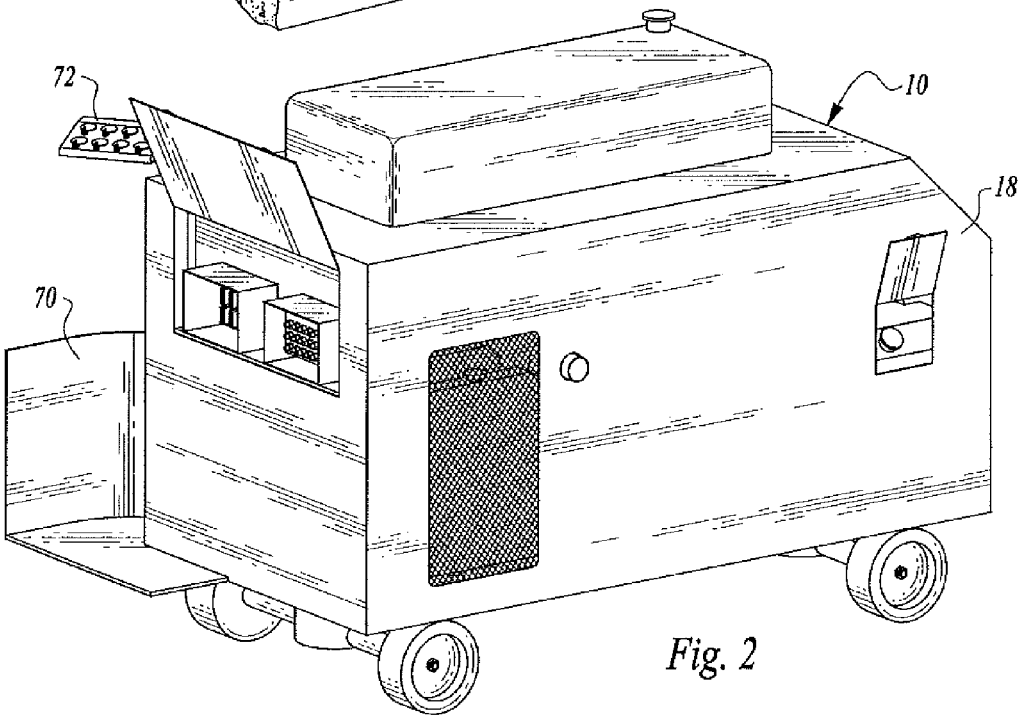
FIG. 2 is a perspective view of the rear and other side of the apparatus.
Figure 3:
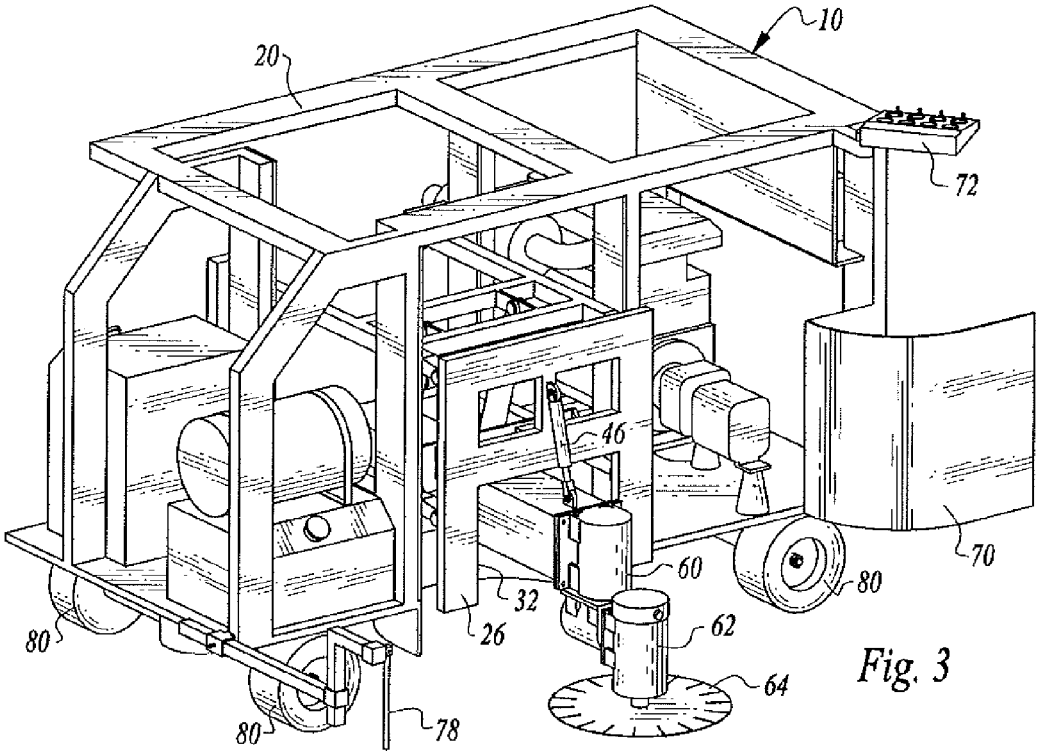
FIG. 3 is a view similar to FIG. 1, the outer body or shell of the apparatus having been removed to show the framework and other inner structural components of the apparatus.

The apparatus 10 includes a wheeled vehicle having an outside body or shell 18 (shown in FIGS. 1 and 2 only), but removed elsewhere to depict the inner structural components of the apparatus. During operation, the apparatus moves along to a concrete curb or other fixed structure as shown by the arrow in FIG. 1.

The vehicle includes a rigid vehicle framework 20. A primary saw support structure is mounted for movement relative to the vehicle framework 20. The primary saw support structure includes a pivoted framework 26 connected to vehicle framework 20 by pivots 28. The pivoted framework 26 includes a front plate 30 defining an opening 32 at the bottom thereof.

Figure 8:
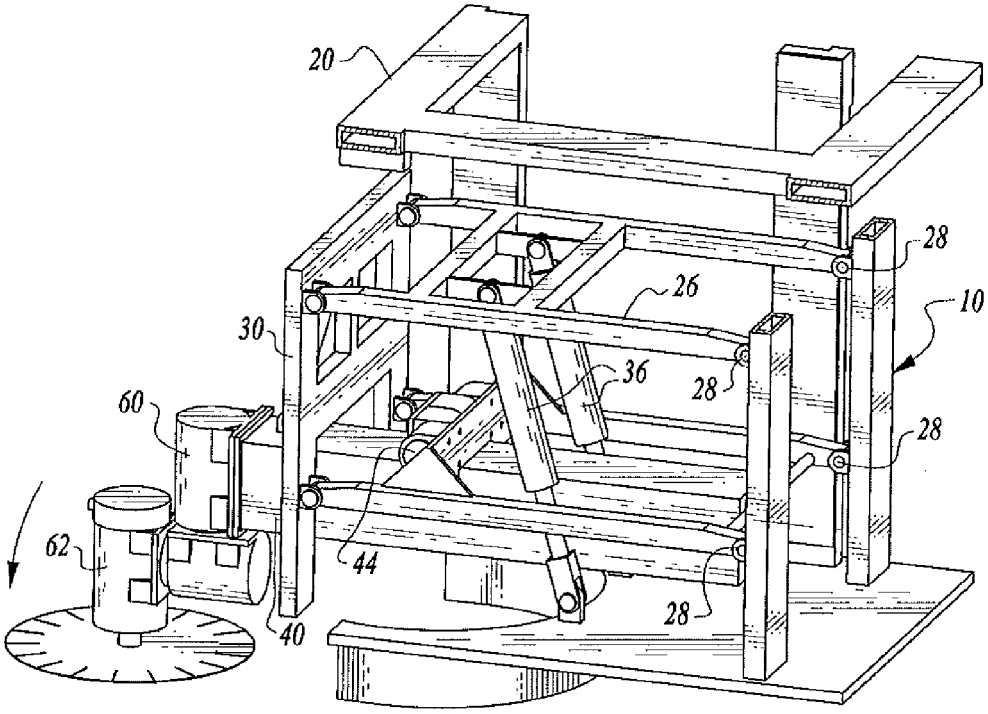
FIG. 8 is a side, elevational view illustrating portions of the primary saw support structure and saw in the positions indicated by solid lines in FIG. 6.
Figure 9:
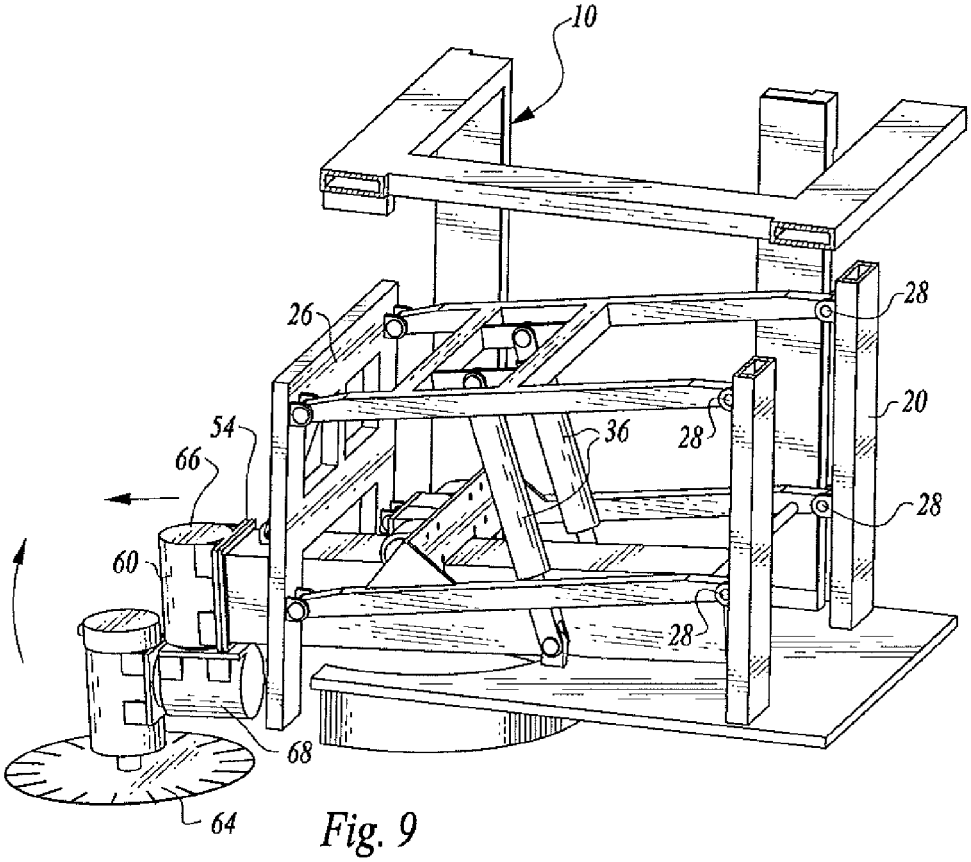
FIG. 9 is a side, elevational view illustrating portions of the primary saw support structure and saw inclined downwardly as depicted by dash lines in FIG. 7.
Figure 10:
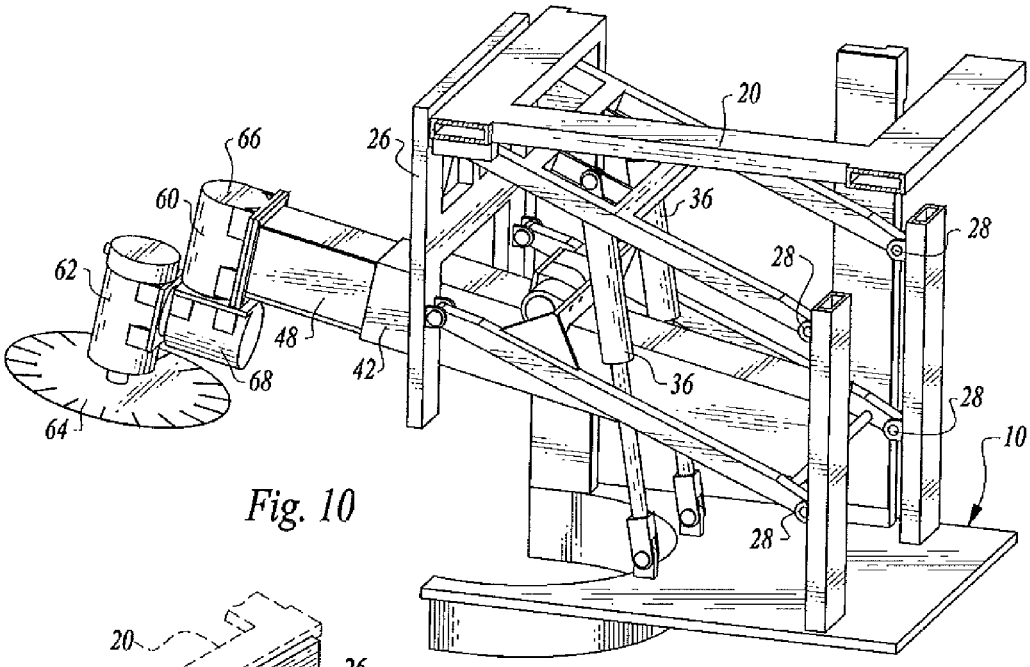
FIG. 10 is a side, elevational view illustrating portions of the primary saw support structure and saw blade inclined upwardly as depicted by solid lines in FIG. 7.
Figure 11:
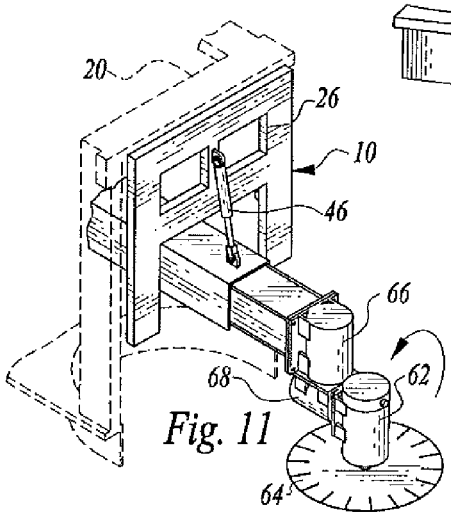
FIGS. 11-14 are perspective views illustrating the saw including rotary saw blade disposed in different representative orientations and positions.
Figure 12:
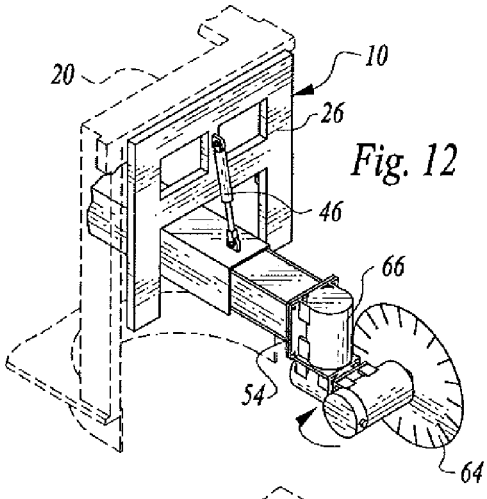
Figure 13:
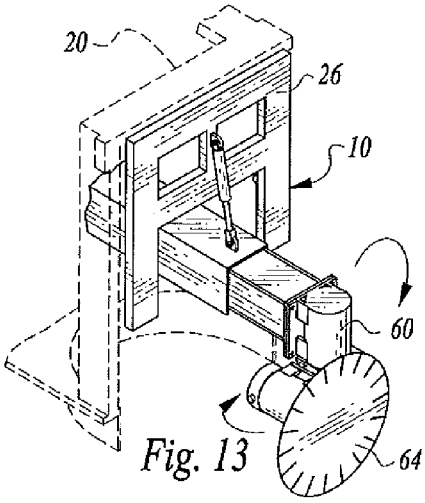
Figure 14:
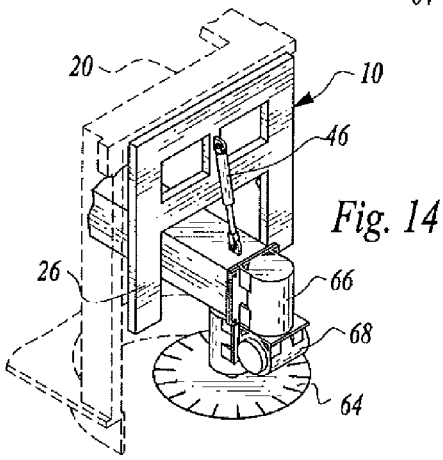

Prime mover structure in the form of hydraulic cylinders 36 is employed with the pivoted framework 26 to tilt or pivot the pivoted framework 26 to move the front plate 30 up or down. FIG. 8, for example, shows the pivoted framework in an intermediate position relative to vehicle framework 20. FIG. 9 shows the pivoted framework 26 tilted or pivoted downwardly by the hydraulic cylinders 36. And FIG. 10 shows the pivoted framework tilted or pivoted upwardly by the hydraulic cylinders 36.

Figure 6:
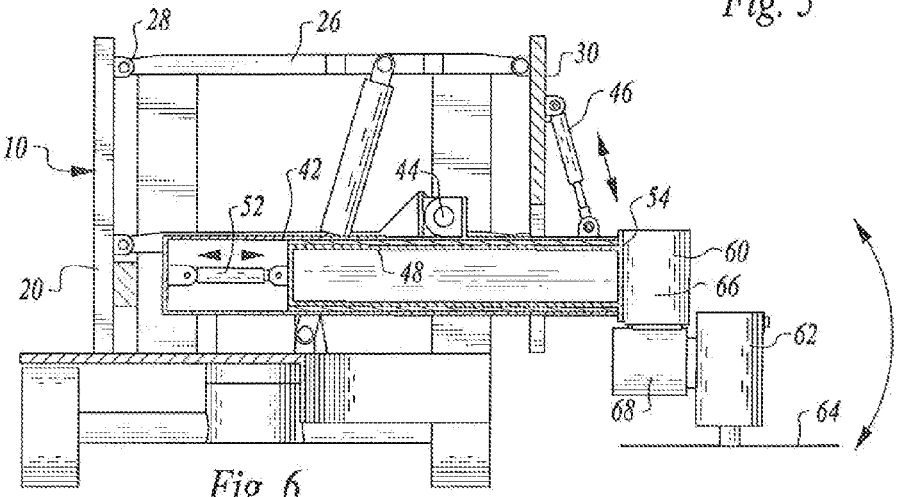
FIG. 6 is a front, elevational, sectional view illustrating a telescopic structure of the primary saw support structure of the present invention fully telescoped and with the rotary saw blade of the saw disposed horizontally.
Figure 7:
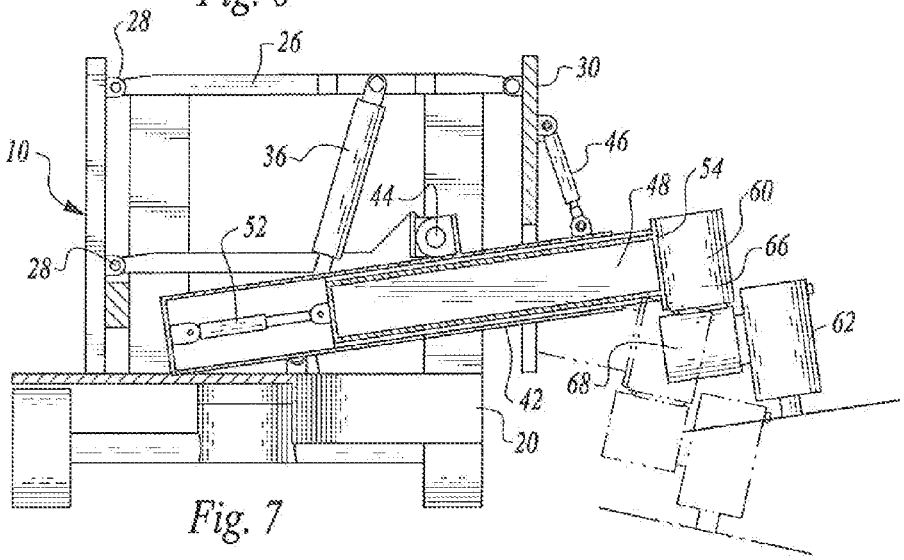
FIG. 7 is a view similar to FIG. 6, but illustrating in solid lines the telescopic structure of the primary saw support structure extended and pivoted to incline upwardly along with the saw, dash lines being used to depict the telescopic structure and the saw blade inclined downwardly relative to the vehicle.

The primary saw support structure additionally includes a telescopic structure 40 supported by the pivoted framework 26 and pivotally moveable therewith upon activation of the hydraulic cylinders 36. The telescopic structure 40 includes a housing or sleeve 42 pivotally connected at pivot 44 to pivoted framework 26. A hydraulic cylinder 46 extending between front plate 30 of pivoted framework 26 and the housing 42 is employed to selectively alternatively raise or lower the telescopic structure relative to the pivotal framework. This action is illustrated for example in FIGS. 6 and 7.

Telescopic member 40 also includes an elongated support member 48 axially slidably moveable relative to the housing and disposed within the housing interior. A hydraulic cylinder 52 interconnects the housing and the elongated support member for selectively alternatively extending or retract the elongated support member. Such action is illustrated for example in FIGS. 6 and 7.

Elongated support member 48 has a distal end 54. The above-described hydraulic cylinder 46 will serve to raise or lower the distal end 54 as will pivotal movement of pivoted framework 26 by hydraulic cylinders 36 in an independent fashion.

An articulated saw support 60 is connected to the distal end of elongated support member 48. A saw 62, which may suitably be hydraulically powered, is supported by articulated saw support 60. The saw has a rotary saw blade 64.

Articulated saw support 60 includes prime mover structure in the form of hydraulically powered rotary actuators 66, 68. Rotary actuator 66 is attached to distal end 54 of the elongated support member. Rotary actuator 66 has a rotary actuator operational axis disposed orthogonally relative to the longitudinal axis of the elongated support structure.

Rotary actuator 68 is attached to and depends from rotary actuator 66. The rotary actuator operational axis of rotary actuator 68 is disposed orthogonally relative to the rotary actuator operational axis of rotary actuator 66.

Rotary actuator 66 is operable to rotate the rotary actuator 68 in a plane orthogonal to the rotary actuator operational axis of rotary actuator 66.

Saw 62 is connected to rotary actuator 68 and rotary actuator 68 is operable to rotate the saw in a plane orthogonal to the operational axis of rotary actuator 68 to change orientation of the rotary saw blade 64. Rotation of rotary actuator 68 by rotary actuator 66 will also rotate the saw in a plane orthogonal to the rotary actuator operational axis of rotary actuator 66.

With the above-described arrangement, actuation of the first prime mover structure is operable to move the primary saw support structure and the saw toward or away from the curb or other fixed structure. The second prime mover structure incorporated in the articulated saw support is operable to move the saw to selectively alternatively position the saw blade in horizontal or vertical planes or canted relative to one or both of the horizontal and vertical planes as selected by the operator of the apparatus. The drawing figures hereof are merely representative of the virtually unlimited placements and orientations of the rotary saw blade that can be accomplished using the apparatus of this invention.

The apparatus also includes safety features and other useful features not incorporated in prior art concrete curb cutter machines. For example, a protective shield 70 is provided to protect an operator of the apparatus from the saw blade and loose material cut by the saw blade. A control console 72 is located at a position on the apparatus at the location of the shield.

Suitably, the apparatus will incorporate sensing structure such as ultrasonic sensor 74 for sensing the location of the saw relative to a curb or other fixed structure being cut by the saw. A water spray nozzle 76 may be incorporated with the saw and articulated saw support adjacent to the rotary saw blade.

Figure 5:
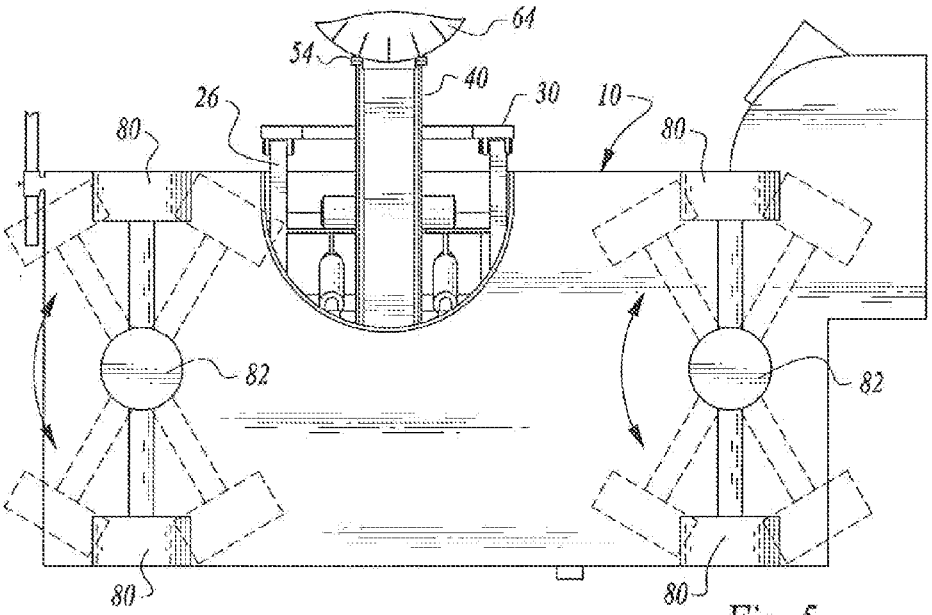
FIG. 5 is a bottom, plan view of the apparatus illustrating wheels of the apparatus in alternative positions shown by solid and dash lines.

A sensor 78 may be attached to the vehicle for sensing the location of the concrete curb or other fixed structure to provide sensor signals employed to guide wheels 80 of the apparatus vehicle. As illustrated in FIG. 5, hydraulically powered rotary actuators 82 may be utilized to steer the vehicle. And such action could be controlled by input from a sensor such as sensor 78. The wheels may be powered by rotary actuators.

The invention claimed is:

1. Apparatus for cutting concrete curbs or other fixed structures both when the vehicle is moving or when the vehicle is stopped, said apparatus comprising in combination:

a vehicle for moving relative to a concrete curb or other fixed structure, said vehicle including a vehicle framework;

a primary saw support structure mounted for movement relative to said vehicle framework;

first prime mover structure for moving said primary saw support structure relative to said vehicle framework;

an articulated saw support including second prime mover structure connected to said primary saw support structure; and a saw having a rotary saw blade attached to said articulated saw support, actuation of said first prime mover structure operable to move the primary saw support structure and the saw toward or away from said curb or other fixed structure, and said second prime mover structure operable to move said saw to selectively alternatively position the saw blade in horizontal or vertical planes or canted relative to one or both of said horizontal and vertical planes, said primary saw support structure completely supporting said articulated saw support and said saw when said apparatus is cutting concrete curbs or other fixed structures and including a pivoted framework having a double-ended rigid upper framework portion including a pair of spaced upper elongated members having upper elongated member inner and outer ends and attached together between said upper elongated member inner and outer ends, a rigid double-ended lower framework portion comprising a pair of spaced lower elongated members having lower elongated member inner and outer ends, and a front plate, said pivoted framework pivotally connected to said vehicle framework by pivots located on the upper elongated member inner ends and on the lower elongated member inner ends, and said front plate pivotally connected by pivots located on the upper elongated member outer ends and the lower elongated member outer ends to the upper and lower elongated member outer ends, said upper and lower elongated members being parallel, said first prime mover structure including at least one upwardly extending first hydraulic cylinder pivotally connected to said double-ended rigid upper framework portion between the upper elongated member inner and outer ends for pivoting said pivoted framework about the pivots at said upper elongated member inner ends to selectively alternatively raise or lower said articulated saw support and said saw, said primary saw support structure additionally including a hollow housing carried by said pivoted framework and an elongated support member within said hollow housing and axially slidable relative to said housing and having an elongated support member distal end, and said first prime mover structure additionally including a second hydraulic cylinder for selectively alternatively extending or retracting said elongated support member relative to said housing, said housing having a housing distal end and said first prime mover structure additionally including a third hydraulic cylinder for alternatively raising or lowering said distal end relative to said framework.

2. The apparatus according to claim 1 wherein said second prime mover structure includes a first rotary actuator attached to the elongated support member distal end and having a first rotary actuator operational axis disposed orthogonally relative to the longitudinal axis of the elongated support member.

3. The apparatus according to claim 2 wherein said second prime mover structure further includes a second rotary actuator attached to and depending from said first rotary actuator, said second rotary actuator operational axis disposed orthogonally relative to the first rotary actuator operational axis, said first rotary actuator operable to rotate said second rotary actuator in a plane orthogonal to the first rotary actuator operational axis.

4. The apparatus according to claim 3 wherein said saw is connected to said second rotary actuator and wherein said second rotary actuator is operable to rotate said saw in a plane orthogonal to the second rotary actuator operational axis to change orientation of said rotary saw blade.

5. The apparatus according to claim 3 wherein said first and second rotary actuators are hydraulic fluid operated rotary actuators.

6. The apparatus according to claim 1 additionally comprising a water spray nozzle connected to said articulated saw support adjacent to said rotary saw blade.

7. The apparatus according to claim 1 additionally comprising a sensing structure for sensing the location of said saw relative to a concrete curb or other fixed structure being cut by said saw.

* * * * *